United States Patent [19]

Brown et al.

[11] 4,444,652

[45] Apr. 24, 1984

[54] UPGRADING GASOLINE DERIVED FROM SYNTHESIS GAS

[75] Inventors: Christopher J. Brown, Tadworth; Antony H. P. Hall, Cobham, both of England

[73] Assignee: The British Petroleum Company Limited, London, England

[21] Appl. No.: 311,465

[22] Filed: Oct. 14, 1981

[30] Foreign Application Priority Data

Oct. 17, 1980 [GB] United Kingdom ..... 8033510

[51] Int. Cl.[3] ..... C10G 35/06

[52] U.S. Cl. ..... 208/135

[58] Field of Search ..... 208/135

[56] References Cited

U.S. PATENT DOCUMENTS

| | | | |
|---|---|---|---|
| 4,049,741 | 9/1977 | Kuo et al. | 208/135 |
| 4,210,521 | 7/1980 | Gorring et al. | 208/89 |
| 4,211,640 | 7/1980 | Garwood et al. | 208/255 |
| 4,234,412 | 11/1980 | Boersma et al. | 208/80 |
| 4,276,151 | 6/1981 | Plank et al. | 208/135 |

FOREIGN PATENT DOCUMENTS

| | | |
|---|---|---|
| 1507778 | 4/1978 | United Kingdom . |
| 1561590 | 2/1980 | United Kingdom . |
| 2051855 | 1/1981 | United Kingdom . |

*Primary Examiner*—Curtis R. Davis

*Attorney, Agent, or Firm*—Brooks, Haidt, Haffner & Delahunty

[57] ABSTRACT

The present invention relates to a process for upgrading low grade gasoline made from synthesis gas, especially the gasoline made from coal-based processes. The process comprises contacting in the vapour phase the low-grade gasoline either alone or admixed with a $C_3/C_4$ hydrocarbon feed with a gallium/aluminosilicate catalyst.

The product gasoline so formed has an octane rating RON (clear) above 100 and a bromine number below 2. The process enables synthesis gas and coal to be used as a source of high grade gasoline.

9 Claims, No Drawings

UPGRADING GASOLINE DERIVED FROM SYNTHESIS GAS

The present invention relates to a process for upgrading low grade gasolines derived from synthesis gas, especially those derived from synthesis gas made from coal.

Processes for converting coal into gasoline are well known. For example Kirk-Othmer's Encyclopedia of Chemical Technology, vol. 4, Second Edition, 1961, pp 450–486 describes several methods of producing gasoline from coal including the Fischer-Tropsch synthesis using iron and cobalt catalysts at normal pressure. The processes used hitherto have however been unable to compete with the production of gasoline from crude oil espcially in respect of the quality of the product. For instance, gasoline derived from coal via synthesis gas is of a low grade, having a research octane number (RON) of less than 40 and a high olefin content as is indicated by a bromine number of about 35. Moreover, crude oil hitherto was comparable as a raw material in cost with coal. These factors together with the failure of the conventional techniques for upgrading low grade gasoline from coal resulted in crude oil being the main source of high grade gasoline.

However, the enormous increase in the price of crude oil in recent years has made coal-based synthesis gas a viable alternative to crude oil as a source of gasoline, provided that low grade gasoline is upgraded.

The low grade gasoline derived from coal-based synthesis gas contains, in addition to olefins, alcohols especially primary alcohols. The presence of these alcohols makes it particularly difficult to upgrade the gasoline by standard distillation techniques.

It is therefore an object of the present invention to upgrade gasolines derived from synthesis gas by increasing the aromatic content thereof and by reducing the olefin content thereof using a catalytic process.

Accordingly, the present invention is a process for upgrading a feedstock comprising low grade gasoline made from synthesis gas characterised in that the feedstock is brought into contact in the vapour phase at an elevated temperature with a catalyst composition comprising an aluminosilicate having a gallium compound deposited thereon and/or an aluminosilicate in which cations have been exchanged with gallium ions, said aluminosilicates having a silica to alumina ratio of at least 5:1.

According to a further embodiment, the present invention is a process for upgrading a mixed feedstock comprising (a) low grade gasoline made from synthesis gas and (b) saturated and/or unsaturated $C_3$–$C_4$ hydrocarbons, characterised in that the mixed feedstock is brought into contact in the vapour phase at an elevated temperature with a composition comprising an aluminosilicate having a gallium compound deposited thereon and/or an aluminosilicate in which cations have been exchanged with gallium ions, said aluminosilicates having a silica to alumina ratio of at least 5:1.

The low grade gasoline made from synthesis gas in the feedstock may be that made by the Fischer-Tropsch normal pressure catalytic process. In this process four main steps are involved. These are:

1. Synthesis gas manufacture by passing steam and oxygen over coal.
2. Purification of synthesis gas to remove e.g. sulphur compounds.

3. Synthesis of hydrocarbons from synthesis gas in the presence of an iron or cobalt catalyst, and
4. Condensation of liquid products and recovery of gasoline from the product gas.

The gasoline thus produced is the so called "low grade gasoline" and usually has a RON of less than 50, contains substantial quantities of $C_5$–$C_{12}$ unsaturated hydrocarbons with a bromine number of 35–40 and also contains oxygenated compounds especially alcohols.

In the case where saturated and/or unsaturated $C_3$–$C_4$ hydrocarbons are present in a mixed feedstock, the source of the $C_3$–$C_4$ hydrocarbons may be any stream which contains these hydrocarbons in major proportions. A particularly suitable source of these hydrocarbons accompanied by small amounts of $C_1/C_2$ hydrocarbons is e.g. by-products from the Fischer-Tropsch synthesis of liquids from synthesis gas, by-product gases from thermal, catalytic or steam cracking of wax distillates, residues and deasphalted oils either before or after hydrotreating. The source of $C_3$ and $C_4$ hydrocarbons may also be liquified petroleum gas found in nature or derived from straight run distillation or from catalytic reforming and hydrocracking processes.

The relative proportions of the low grade gasoline and the $C_3$–$C_4$ hydrocarbons in the mixed feedstock is suitably between 1:2 and 6:1 by weight.

The gallium in the catalyst composition may be present as gallium oxide and/or as gallium ions if cations in the aluminosilicate support have been exchanged with gallium ions. In the case where the cations in the aluminosilicate have been exchanged for gallium ions, the gallium ion is suitably provided as an aqueous solution of a gallium salt such as for instance gallium nitrate, gallium chloride or gallium sulphate. Such catalysts may be produced by conventional ion exchange techniques and the catalysts so produced are subsequently dried. For example and aqueous solution of a gallium compound such as gallium nitrate may be placed in contact with the aluminosilicate at ambient or elevated temperature, e.g. by refluxing. The exchangedaluminosilicate is then separated by decantation followed by filtration, washed several times with deionised water and finally dried. Before addition to the aqueous solution of the gallium compound, the aluminosilicate may be treated in various ways e.g. as described in our published copending European Patent Application No. 0024930.

The present invention may also be carried out using catalysts in which the gallium deposited is impregnated on the surface of the aluminosilicate or is incorporated in the intra-crystalline zeolite cavities as a gallium compound which gives rise to gallium oxide during activation of the catalyst prior to contact with the hydrocarbon feedstock. An example of a suitable gallium compound is gallium nitrate. Conventional impregnation techniques may be used to produce these catalysts.

The impregnation may be achieved by preparing a solution, suitably an aqueous solution, of a gallium compound such as for example gallium nitrate and adding a conventional aluminosilicate to this aqueous solution with thorough stirring to form a paste. The paste is subsequently dried at an elevated temperature under vacuum.

Where the catalyst composition is prepared by using a compound of gallium which ionises in aqueous solution, for example gallium nitrate, it is inevitable that some of the gallium ions will be exchanged with the cations in the aluminosilicate even if the preparation was by impregnation of the aluminosilicate.

The aluminosilicates which have gallium oxide deposited thereon and/or in which an exchange with gallium ions may be carried out, suitably have a silica to alumina ratio of between 20:1 and 200:1 and have the general formula $M_{2/n}O.Al_2O_3.ySiO_2zH_2O$ wherein M is a cation which is a positively charged ion selected from a metal ion or an organic ion of valence n and a proton, y is an integer greater than 5 and z is from 0 to 40. The metal cation, M, is preferably an alkali metal or alkaline earth metal ion, preferably sodium or potassium ions. The organic cations may suitably be represented by the formula $R^1R^2R^3R^4N^+$ or by an ion derived from the amine $R^1R^2R^3N$ or diamine $R^1R^2N(CH_2)_xNR^3R^4$ or pyrrolidine where $R^1R^2R^3$ and $R^4$ may be —H, $—CH_3$, $—C_2H_5$, $—C_3H_7$, $—C_4H_9$ or $—CH_2CH_2OH$ and x equals 2, 3, 4, 5 or 6. The ZSM variety of zeolites, for example ZSM-5, ZSM-8, ZSM-11 and ZSM-12 may be used. These zeolites are usually produced from a silica source, an alumina source, an alkalimetal hydroxide and an organic nitrogen containing cation. However, the zeolites may also be derived directly using a nitrogen-containing base, instead of a cation, such as an alkanolamine, e.g. diethanolamine. These types of aluminosilicates are preferred and are described in our European Patent Application Publication Nos: 0002899 and 0002900.

Whichever method of catalyst preparation is used, the amount of gallium present in the catalyst compositions may vary for instance between 0.05 and 10% by weight of the total aluminosilicate in the catalyst composition. The gallium exchanged or impregnated zeolite thus obtained may be combined with a porous matrix, e.g. silica or alumina or other inorganic compositions to improve the mechanical strength of the catalyst.

The catalyst composition is suitably activated prior to contact with the low grade gasoline feedstock whether used alone or admixed with $C_3$–$C_4$ hydrocarbons. The activation may be carried out by heating the catalyst at a temperature of between 400° C. and 650° C., preferably between 500° C. and 600° C. Activation may be carried out in an atmosphere of hydrogen, air or gas inert under the reaction conditions such as nitrogen, but most preferably in an atmosphere containing oxygen. The activation may be carried out in the reactor itself prior to the reaction. The catalyst composition is suitably used as a fixed bed, a moving bed or fluidised bed.

The low grade gasoline feedstock or mixed feedstock is thereafter contacted in the vapour phase with the catalyst composition at a temperature between 300° C. and 700° C. preferably between 400° C. and 600° C. An inert atmosphere may be provided by a gas inert under the reaction conditions such as nitrogen. The products of the reaction are then isolated by distillation.

The principle advantages of the present invention are:

(a) the production of highly aromatic products useful as a gasoline blending component or as a petrochemical feedstock (b) the improvement of the RON and particularly the motor octane number (MON), whilst reducing the olefin content of the low grade gasoline feedstock for use as gasoline blending components, and (c) the generation of hydrogen as a useful co-product.

The invention is further illustrated with reference to the following examples.

EXAMPLES 1 AND 2

The catalyst used in these Examples was obtained by ion-exchanging a high silica zeolite having a silica to alumina ratio of 40:1, prepared in its hydrogen form, with gallium nitrate solution (0.05 g Ga/ml). The dry product was mixed with a silica binder, dried and sieved to 12 to 30 BSS mesh. The resulting catalyst contained 1.6% by weight of gallium and 29% by weight of the silica binder. 200 ml of this catalyst was charged to a fixed bed reactor and air was passed over the bed at 550° C. for 2–3 hours. Thereafter, the reactor was flushed with nitrogen for 0.5 hours to remove any traces of air. The respective low grade gasoline (Example 1) and mixed feedstock (Example 2) were then preheated to the respective reaction temperatures as shown and then passed over the catalyst bed. The low grade gasoline used in the Examples was a '$C_5$ to $C_{12}$' Fischer-Tropsch product and had the following product spectrum and physical characteristics:

The low grade gasoline had the following carbon no. distribution by weight (%) as determined by gas-liquid chromatography.

| | wt % |
|---|---|
| $C_3$ | 0.08 |
| $C_4$ | 0.62 |
| $C_5$ | 2.52 |
| $C_6$ | 6.81 |
| $C_7$ | 12.84 |
| $C_8$ | 17.27 |
| $C_9$ | 19.05 |
| $C_{10}$ | 18.77 |
| $C_{11}$ | 15.55 |
| $C_{12}$ | 5.58 |
| $C_{13}$ | 0.64 |
| Total | 100.03 |

The other physical characteristics of this low grade gasoline were:

| | |
|---|---|
| Density (at 15° C.) | 0.7275 |
| Sulphur content (ppm) | less than 4 |
| Nitrogen (ppm wt/vol) | 0.4 |
| Bromine No. | approx 35 |
| ROM (clear) | less than 40 |
| Olefins (% vol) | 29.3 |
| Saturated hydrocarbons (% vol) | 70.7 |
| Aromatics | Nil |

The $C_3$–$C_4$ hydrocarbon stream used in Example 2 was liquified petroleum gas (LPG) which consisted by weight of 7.7% propane, 32.8% butanes and 30.3% butenes. The reaction conditions used and the results achieved with each feedstock is shown below.

EXAMPLE 1

(low grade gasoline alone as feedstock)

| Reaction conditions: | |
|---|---|
| Temperature | 525° C. |
| Pressure | 7 bar absolute |
| Feed rate | 4.0 LHSV |

Under the above conditions the reaction yielded at 47% by weight of liquid product which had an aromatic content of 97.7% by weight made up as follows:

| | |
|---|---|
| Benzene | 16.0 by weight |
| Toluene | 33.6 |
| $C_8$ | 33.5 |
| $C_9$ | 8 |
| Polycyclic aromatics | 6.4 |

The remainder of the reaction products % by weight were:

| | |
|---|---|
| Hydrogen | 1.2 |
| $C_1$ | 9.1 |
| $C_2$ | 9.5 |
| $C_3$ | 28.0 |
| $C_4$ | 5.0 |

The product also contained 365 μg/g of water.

The final liquid product had a RON (clear) of 110, a MON of 100 and a Bromine No. 1.5.

EXAMPLE 2

(mixed feedstock containing the low grade gasoline and LPG in the ratio of 1.0:0.58 by weight).

| Reaction conditions: | |
|---|---|
| Temperature | 530° C. |
| Pressure | 7 bar absolute |
| Feed rate | 4.3 LHSV |

Under the above conditions the reaction yielded 79% by weight of a product based on liquid fed. The liquid product contained 99.0% aromatics which had the following product spectrum

| | |
|---|---|
| Benzene | 21% weight |
| Toluene | 34 |
| $C_8$ | 27 |
| $C_9$ | 5 |
| Polycyclic aromatics | 12 |

The remainder of the reaction products % by weight were:

| | |
|---|---|
| Hydrogen | 1.7 |
| $C_1$ | 17.3 |
| $C_2$ | 9.9 |
| $C_3$ | 17.4 |

-continued

| | |
|---|---|
| $C_4$ | 3.7 |

The product also contained 280 μg/g of water. The final liquid product had a RON (clear) of 109, a MON of 101 and a Bromine no. of 1.8.

We claim:

1. A process for upgrading a feedstock comprising low grade gasoline made from synthesis gas, wherein said low grade gasoline has a RON of less than 50, contains substantial quantities of $C_5$–$C_{12}$ unsaturated hydrocarbons with a bromine number of 35–40 and also contains oxygenated compounds, characterised in that the feedstock is brought into contact in the vapor phase with a catalyst composition comprising an aluminosilicate having a gallium compound deposited thereon and/or an aluminosilicate in which cations have been exchanged with gallium ions, said aluminosilicates having a silica to alumina molar ratio of at least 5:1.

2. A process according to claim 1 wherein the feedstock comprises a mixture of (a) low grade gasoline made from synthesis gas and (b) saturated and/or unsaturated $C_3$-$C_4$ hydrocarbons.

3. A process according to claim 2 wherein the source of $C_3$–$C_4$ hydrocarbons mixed with the low grade gasoline is the by-products from the Fischer-Tropsch synthesis of liquids from synthesis gas, by-product gases from thermal, catalytic or steam cracking of wax distillates, residues or deasphalted oils either before or after hydrotreatment.

4. A process according to claim 2 wherein the source of $C_3$–$C_4$ hydrocarbons mixed with the low grade gasoline is selected from liquified petroleum gas (i) found in nature and (ii) derived from straight run distillation, catalytic reforming or hydrocracking processes.

5. A process according to claims 2 wherein the relative proportions of the low grade gasoline and the $C_3$–$C_4$ hydrocarbon in the mixed feedstock is between 1:2 to 6:1 by weight.

6. A process according to claim 1 or 2 wherein the aluminosilicate in the catalyst composition has the formula $M_{2/n}O.Al_2O_3.ySiO_2.zH_2O$ wherein M is acation of valence n or a proton, y is an integer greater than 5 and z is from 0 to 40.

7. A process according to claim 6 wherein the value of y in the aluminosilicate is between 20 and 200.

8. A process according to claim 1 or 2 wherein the catalyst composition is activated by heating at a temperature between 400° and 650° C. prior to contact with the feedstock.

9. A process according to claim 1 or 2 wherein the feedstock is contacted with the catalyst composition at a temperature between 300° and 700° C. in an atmosphere inert under the reaction conditions.

* * * * *

UNITED STATES PATENT AND TRADEMARK OFFICE

CERTIFICATE OF CORRECTION

PATENT NO. : 4,444,652

DATED : April 24, 1984

INVENTOR(S) : Christopher J. Brown et al

It is certified that error appears in the above-identified patent and that said Letters Patent is hereby corrected as shown below:

Col. 2, line 41, "exchangedaluminosilicate" should read --exchanged aluminosilicate--

Col. 6, Claim 5, line 40, "1:2 to 6:1" should read --1:2 and 6:1--

Col. 6, Claim 6, line 43, "acation" should read --a cation--

Signed and Sealed this

*Thirtieth* Day of *April 1985*

[SEAL]

*Attest:*

DONALD J. QUIGG

*Attesting Officer* *Acting Commissioner of Patents and Trademarks*